US006279534B1

(12) United States Patent
Schreurs et al.

(10) Patent No.: US 6,279,534 B1
(45) Date of Patent: Aug. 28, 2001

(54) METHOD FOR CONTROLLING THE POWER SUPPLY TO A VEHICLE ENGINE

(75) Inventors: Bart Hubert Schreurs, Athus (BE); Michel Henri Peters, Luxembourg (LU)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/391,576

(22) Filed: Sep. 8, 1999

(30) Foreign Application Priority Data

Sep. 30, 1998 (DE) ..... 198 44 822

(51) Int. Cl.[7] ..... F02D 11/10; F02D 41/22

(52) U.S. Cl. ..... 123/396; 123/399

(58) Field of Search ..... 123/198 D, 361, 123/396, 399, 479

(56) References Cited

U.S. PATENT DOCUMENTS 4,920,939 * 5/1990 Gale ..... 123/399
5,339,782 * 8/1994 Golzer et al. ..... 123/399
5,669,353 * 9/1997 Shirai et al. ..... 123/399
5,960,771 * 10/1999 Watanabe ..... 123/399
5,983,859 * 11/1999 Breudigam et al. ..... 123/399 X
5,999,875 * 12/1999 Breudigam et al. ..... 123/399 X
6,073,610 * 6/2000 Matsumoto et al. ..... 123/399 X

FOREIGN PATENT DOCUMENTS 10-176581 * 6/1998 (JP) .

* cited by examiner

*Primary Examiner*—Tony M. Argenbright
(74) *Attorney, Agent, or Firm*—Vincent A. Cichosz

(57) ABSTRACT

A method for controlling a power supply for a vehicle engine utilizes two sensors monitoring a power supply control member. In the event of a disturbance of the one of the sensor signals, the other sensor signal is used for determining the actuator control signals. If such other sensor signal exceeds a limit value, the actuator control signals are determined by a proportional-plus integral control, with the integral portion of the control being based on an operating state of the vehicle when the limit value is exceeded.

18 Claims, 2 Drawing Sheets

METHOD FOR CONTROLLING THE POWER SUPPLY TO A VEHICLE ENGINE

TECHNICAL FIELD

The invention concerns a method for controlling the power supply to a vehicle engine, wherein depending on the deviation between the respective current operating state of the vehicle and a desired operating state and on account of signals of at least two sensors monitoring a control member control signals are delivered to an actuator which controls the power supply to the vehicle engine.

Similarly the invention concerns a device for controlling the power supply to a vehicle engine having at least two sensors monitoring a control member, evaluating means comparing the current operating state of the vehicle with a desired operating state in dependence on the signals of the sensors, and control means providing controlling signals to an actuator in dependence on the result of the comparison performed by the evaluating means, which actuator controls the power supplied to the vehicle engine.

BACKGROUND OF THE INVENTION

Stricter and stricter requirements of environmental conservation have led to modern motor vehicles equipped with internal combustion engines being equipped with so-called "engine management systems". These systems ensure that the engine is always operated at an operating point at which, taking into account the respective requirements of the vehicle driver and the external conditions, the best consumption and the lowest pollutant emission occur.

A problem with engine control systems used today lies in that actuation of the throttle valve arranged in the intake port of the engine is as a rule actuated directly by the driver via a linkage connected to an actuating means, for example a foot pedal or a manual actuator, or a control cable. As a result, engine management follows the displacement of the throttle valve by the driver even when the speed of displacement or the respective opening angle of the throttle valve is not optimally adapted to the operating situation in which the engine and with it the motor vehicle find themselves.

Owing to the difficulties arising from direct coupling of the actuating means and the throttle valve which serves as the actuator for the power consumption of the engine, there has been a change-over to separating the mechanical connection between the actuating means and the actuator. Instead of the mechanical coupling, there is then provided a control device which by means of suitable sensors detects the respective position of the actuating means. Taking into account the vehicle user's standards which then arise and the respective operating situation of the engine, a position of the actuator with which the driver's requirement can be fulfilled in an optimal manner is determined.

In such "drive by wire" systems, the actuator (the throttle valve) is actuated by a servo motor which is controlled by the engine management system. By the fact that the respective current position of the throttle valve is compared with the required position by means of suitable sensors, a closed-loop control algorithm of the engine management system here ensures that the throttle valve is moved into the desired position and stays in it.

Owing to the non-linear relationship between the throttle valve position and the respective operating situation, with known engine management systems the position of the actuator is not directly converted to a corresponding position of the control member. Instead, the position of the actuator is allocated a control value which, taking into account the current operating state of the engine or vehicle, is taken from a data field, the so-called "throttle valve field". In this data field are stored, for example in dependence on the speed of the engine and the respective gear speed engaged, control values which ensure that the respective requirement of the driver indicated by a displacement of the actuating means is fulfilled optimally. Control signals corresponding to the control values concerned are then transmitted to the actuating means which displaces the actuator accordingly.

In order to ensure maximum possible reliability in detection of the signals needed for control of the engine, with known "drive by wire" systems the actuator and the actuating means are each allocated at least two sensors. Their signals are compared with each other, assuming that the signals delivered are error-free as long as they match, apart from a tolerance range.

A problem arises with such systems when one of the sensors is defective or when there is a disturbance of signal transmission for other reasons. In such cases under certain conditions it is difficult to establish which sensor is still delivering a reliable signal and which one is actually unusable. This is true particularly if a disturbance that is only irregularly repeated occurs.

To ensure that in the event of a disturbance of the sensors or signal transmission there is no misinterpretation by the control device of the signals received by the sensors, with known engine management systems it is provided that in the event of such a disturbance the idling state of the engine is automatically induced or the engine is completely turned off. Regardless of the respective driving situation in which the vehicle is at the time the disturbance occurs, in such an event the engine is provided with only as much power as it needs in the idling state. This can lead to considerable difficulties particularly if the vehicle is moving at high speed at the moment of the defect, for example during overtaking.

SUMMARY OF THE INVENTION

It is the object of the invention to improve a method and a device of the kind mentioned hereinbefore to the effect that a vehicle can move safely even in the event of a disturbance of the signals needed for control of the engine.

This object is achieved as regards the method by the fact that in the event of a disturbance of the signal of one of the sensors the undisturbed signal of the other sensor is used for determining the control signals delivered to the actuator until the desired change of the operating state indicated by the undisturbed signal exceeds a limit value as regards the respective operating state, and that in the event of exceeding the limit value the control signals for the actuator are determined along the lines of a proportional-plus integral control unit, wherein the starting value for the integral portion of the automatic control is determined to be equal to an initial value which is allocated to the operating state of the vehicle at the time of exceeding the limit value.

As regards the device the invention is achieved by the fact that there are provided a memory, in which initial values are stored in dependence on determined operating states of the vehicle, and a calculating unit, which determines the control signals for the actuator by a proportional-plus integral control unit when in the event of a disturbance of the signal of one of the sensors the desired operating state is above a limit value, wherein the calculating unit determines the starting value of the proportional-plus integral control equal to the initial value which is allocated to the respective current operating state.

According to the invention, in the event of a disturbance of the signal of one of the sensors, which for example can be triggered by a defect of the respective sensor itself or some other disturbance during determination and transmission of the signals of the sensors, the vehicle engine cannot be immediately forced into an idling state. Instead, the undisturbed signal of the other sensor is used to control the engine. Meanwhile, as a safeguard against a malfunction threatening the driver, there is constant monitoring of whether the desired operating situation predetermined by the driver and indicated by the still intact sensor signal is still below a limit value. This limit value corresponds for example to the maximum acceleration which is permitted, taking into account the respective engaged gear speed of the engine under certain operating conditions.

If this limit value is exceeded, instead of direct conversion of the respective sensor signal to a control signal for the actuating means, a power supply control system is set in operation, within which the control signals for the actuator along the lines of a proportional-plus integral control unit are composed of an integral portion and a proportional portion. It can happen that the limit value is exceeded if, for example, the signal of the sensor which has been undisturbed until then is disturbed and hence also becomes unreliable.

By means of the method according to the invention and the device which is particularly suited to carrying it out, in such an event the performance of the vehicle engine is controlled in such a way that the driver always has sufficient reaction times available to move the vehicle reliably into a position in which it can be turned off safely. In this way it is ensured that even in the "disturbance mode", that is, when the signal of one sensor is disturbed, operating states which would constitute a threat to the driver and his vehicle are avoided.

The starting value for the integral portion of the control provided according to the invention in the event of a disturbance is taken from a separate memory in which are stored a plurality of initial values for certain operating conditions. Here the respective value is selected in dependence on the respective operating state of the vehicle, for example in dependence on the current engine speed, the current gear speed engaged, the current vehicle speed and/or the current acceleration, and used as the starting value.

Thus the values stored in the memory can correspond to the control signals which would be delivered under certain standardized operating conditions, in order to achieve the desired operating state in the best possible way. In this way control can for example be based on a starting value corresponding to the control signal which would be delivered to the actuator in the event of undisturbed operation on a flat road, in order to maintain a certain acceleration. Thus in the event of exceeding the limit value when sensors are disturbed the vehicle is forced to adopt a behavior corresponding to a driving situation that is easy for the driver to overcome.

The risk of unstable behavior of the control unit, which would arise for example if disturbed information on the current position of the actuator were taken into account as the starting value, is averted by determination of the starting value of proportional-plus integral control as provided according to the invention. Similarly in this way the proportional-plus integral control is prevented from being based on starting values which would lead to overcontrol of the actuator.

The sensors can be those sensors which are used for monitoring and detecting the position of an actuating means with which the driver selects the desired operating state. This actuating means can for example be a foot accelerator pedal or a throttle hand lever. Alternatively or in addition, the control element monitored by the sensors can also be the actuator itself, for example the throttle valve in the intake tract of an internal combustion engine. Regardless of which signal of the sensors allocated to these control elements is disturbed, the invention allows reliable continuing movement of the vehicle as long as there is at least one undisturbed signal by means of which the operating situation desired by the driver can reliably be established.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
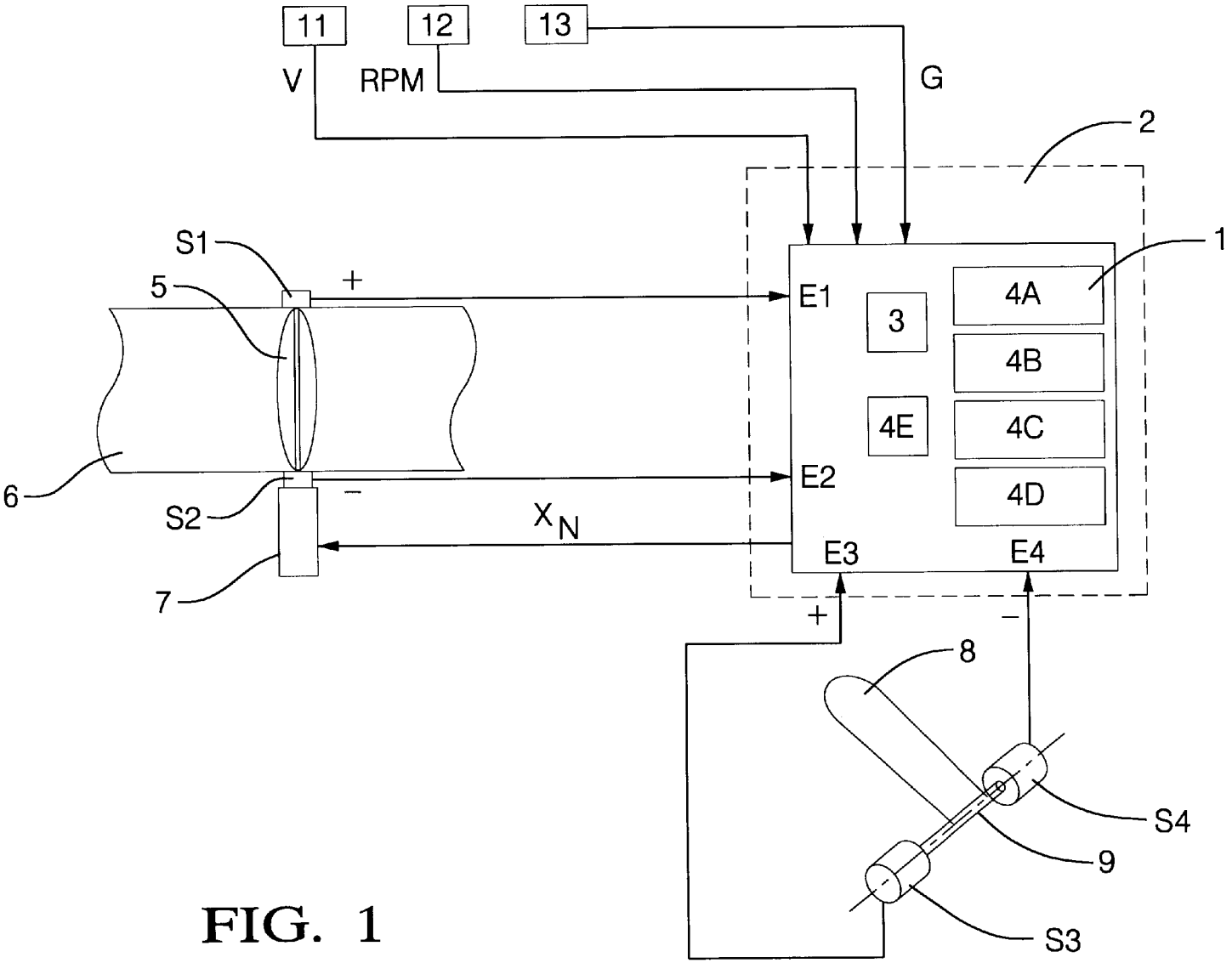
FIG. 1 is a device for controlling the power supply, used in conjunction with the throttle valve of a motor vehicle internal combustion engine.
Figure 2:
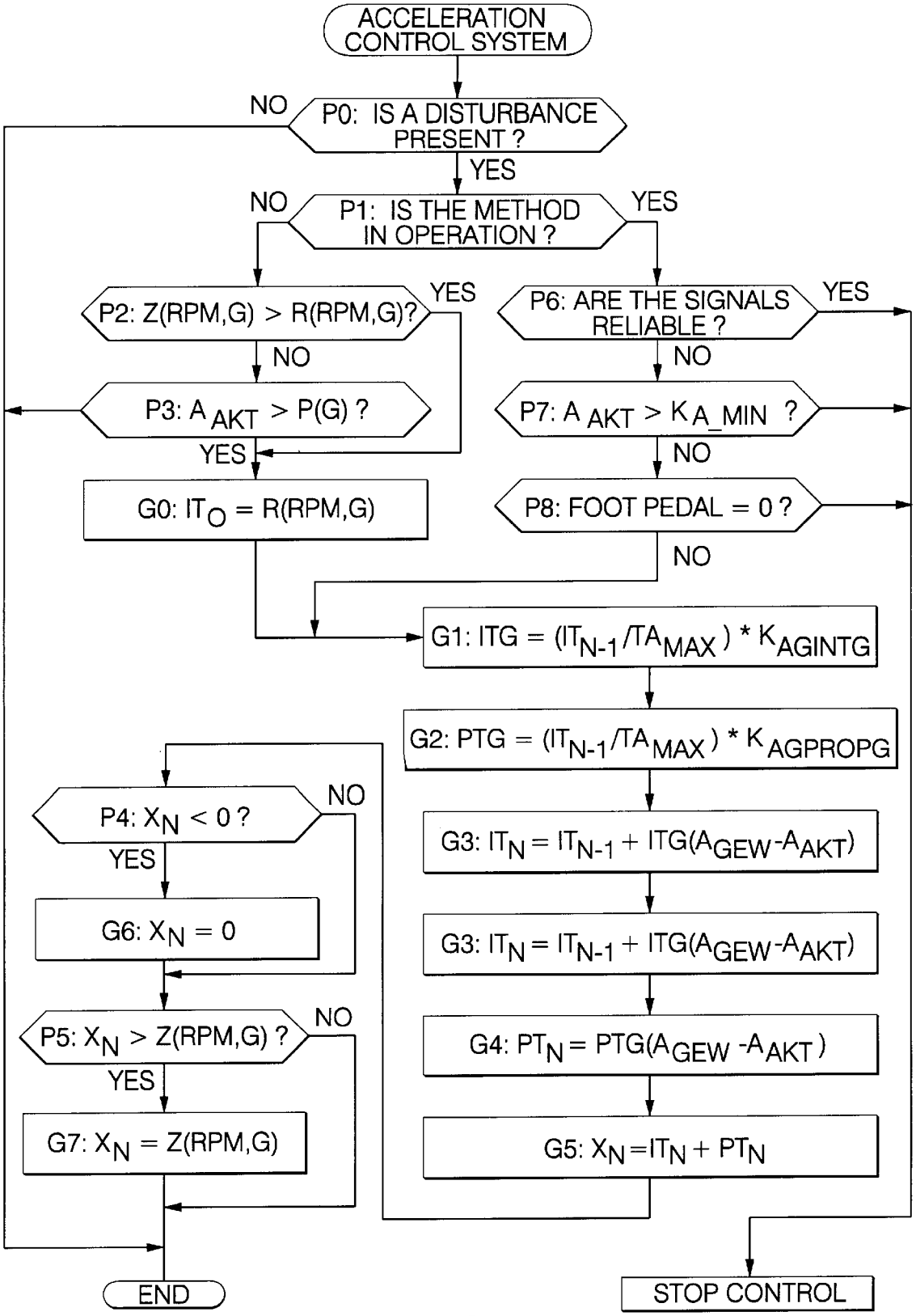
FIG. 2 is a flow chart in which is shown the sequence of steps of the method undergone in the event of a disturbance.

The device shown in FIG. 1 includes a control device 1 which forms part of the acceleration control of an engine management system 2 not shown in detail. Within the control device 1 are provided a computer unit 3 and a first memory 4*a* in which a plurality of initial values R(rpm,g) are stored after the fashion of a table. Each initial value R is allocated a given engine speed rpm and a given gear speed g of a vehicle gearbox, not shown, which is connected to the internal combustion engine, also not shown. In this way access to the initial values R is possible in dependence on the respective current engine speed rpm and the respective currently engaged gear g of the gearbox.

The initial values R(rpm,g) correspond to the positions which the actuator 5 designed as a throttle valve would occupy if, on a road without inclination in a given engaged gear speed g of the vehicle gearbox, a given acceleration of the engine is to be maintained.

The control device 1 comprises inputs E1, E2, E3, E4 at which occur the signals of sensors S1, S2, S3, S4. Two of the sensors S1, S2, S3, S4 are in each case allocated in pairs to one of the control elements of the device. Thus the two sensors S1, S2 detect the angular position of a throttle valve 5 which acts as an actuator for the power supply to the engine and which is arranged in the intake port 6 of the engine. In this case the sensor S2 delivers a signal which is inverted compared with the signal of the sensor S1, so that the sum of the two signals formed in the control device 1 is zero when the sensors S1, S2 are intact, apart from a tolerance range.

A servo motor 7 is provided as the actuating means for displacement of the throttle valve 5. The servo motor 7 displaces the throttle valve 5 in dependence on control signals $X_n$ which it receives from the control device 1.

The respective desired operating state of the vehicle which is driven by the engine and also not shown is selected by the driver by means of the foot-operated accelerator pedal 8 serving as the actuating means. This accelerator pedal 8 is mounted pivotably on a shaft 9. The pivot position of the accelerator pedal 8 is detected by the second sensor pair S3, S4 which are directly coupled to the pivot shaft 8. The sensors S3, S4, like the sensors S1, S2, deliver signals inverted from each other, whose sum yields zero in the normal state, apart from tolerance-related deviations.

In a second memory 4*b* of the control device 1 the maximum permitted accelerations of the vehicle in dependence on the respective gear speed g are filed as limit values P(g) also after the fashion of a table, so that the calculating unit 3 can access the respective limit values P(g) in dependence on the respective current gear speed g.

In addition there is provided a third memory 4*c* of the control device 1, in which are stored constants $K_{a_min}$, $K_{AGINTG}$ and $K_{AGPROPG}$. The constant $K_{a_min}$ represents a minimum acceleration, while, as described below, the values for determination of the portions of the control signals $X_n$ are influenced through the constants $K_{AGINTG}$ and $K_{AGPROPG}$.

In a fourth memory 4*d* are stored the control signal values Z(rpm,g) which during proper functioning are allocated by the calculating unit 3 to the respective position of the accelerator pedal 8, in order to achieve or to maintain the desired operating state of the vehicle engine during undisturbed operation.

Finally there is provided a buffer memory 4*e* in which is stored an integral portion $iT_n$[n=0 . . . m] calculated in the respective current step for use in a subsequent step of the method according to the invention described below.

The respective current speed v of the vehicle is detected by means of a speed sensor 11. The current speed rpm of the engine is monitored by a revolution counter 12. By means of a monitoring device 13 the respective engaged gear speed g of the vehicle gearbox is detected. The data on the engine speed rpm, the vehicle speed v and the currently engaged gear speed g are transmitted to the control device 1.

When the sensors S1, S2, S3, S4 are functioning properly, the calculating unit 3 sets the control signal $X_n$ delivered to the servo motor 7 equal to the control signal value Z which is selected from the memory 4*d* for the desired operating state indicated by the position of the accelerator pedal 8 in dependence on the current speed rpm of the engine and on the currently engaged gear speed g.

The control device 1 detects a disturbance if the signal of one of the sensors S1, S2, S3, S4 is disturbed, or if the sum of the signals of the sensors S1, S2 or S3, S4 differs from zero beyond a tolerance range.

If one of these criteria is fulfilled (test P0), the method according to the invention is initiated. In the process it is first checked by the control device 1 whether the method has already been set in operation before (test P1).

If this is not the case, it is tested whether the control signal Z(rpm,g) which under normal conditions would be allocated to the acceleration $a_{gew}$ wanted by the driver is above the initial value R(rpm,g) which is allocated to the respective engine speed rpm and the respective engaged gear speed g (test P2).

If test P2 yields a negative result, in test P3 it is in addition checked whether the current vehicle acceleration $a_{akt}$ which is necessary to achieve or to maintain the desired change in the operating state of the vehicle is above the limit value P(g) which is selected from the memory 4*c* of the control device 1 by the calculating unit 3 in dependence on the currently engaged gear speed g of the vehicle gearbox. By this check it is ensured that the respective current acceleration $a_{akt}$ never exceeds the maximum permitted acceleration referred to the respective engaged gear speed g, which maximum acceleration is represented by the limit value P(g). If this test P3 shows that the respective control signal value Z(rpm,g) is lower than the respective limit value R(rpm,g), the control signal $X_n$ delivered to the servo motor 7 is set equal to the control signal Z(rpm,g) which is allocated to the respective engine speed rpm and the respective engaged gear speed g and which is selected from the memory 4*d*.

If on the other hand one of the tests P2, P3 yields a positive result, proportional-plus integral control is initiated.

For this purpose the starting value $iT_0$ of an integral portion $iT_n$ [n=0 . . . m] is set equal to the initial value R(rpm,g) which is taken from the memory 4*a* and which is allocated to the current engine speed rpm and the currently engaged gear speed g (equation G0).

Next the gain factors iTG, pTG for the integral portion $iT_n$ and the proportional portion $pT_n$ of the respective control signal $X_n$ are successively determined according to the following equations:

$$iTG=(iT_{n-1}/TA_{Max})*K_{AGINTG} \quad \text{G1}$$

$$pTG=(iT_{n-1}/TA_{Max})*K_{AGPROPG} \quad \text{G2}$$

in which iTG=gain factor of the integral portion, pTG=gain factor of the proportional portion, $TA_{Max}$=control signal corresponding to the maximum value of the position of the actuator, $K_{AGINTG}$=constant $K_{AGPROPG}$=constant.

By means of the constants $K_{AGINTG}$ and $K_{AGPROPG}$ the effect of the respective gain factor iTG, pTG on the respective control signal $X_n$ can be adapted to the properties and operating behavior of the engine and vehicle.

By the fact that the integral portion $iT_{n-1}$ of the respective previous step when determining the gain factors iTG, pTG is divided by the control signal $TA_{MAX}$ corresponding to the maximum value of the position of the control member, allowance is made for the fact that, in the event that in the current operating state the engine is operated at low performance, already small changes in the position of the actuator can cause a considerable change in the engine performance, whereas at high engine performance big changes in the position of the actuator are necessary to bring about a noticeable change at all.

Then the integral portion $iT_n$ and the proportional portion $pT_n$ are updated according to the following equations:

$$iT_n=iT_{n-1}+iTG(a_{gew}-a_{akt}) \quad \text{G3}$$

$$pT_n=pTG(a_{gew}-a_{akt}), \quad \text{G4}$$

in which $iT_n$=integral portion for the previous step, $iT_{n-1}$=integral portion for the respective previous step, $pT_n$=proportional portion for the current step, $a_{gew}$=desired acceleration, $a_{akt}$=current acceleration.

Finally the control signal $X_n$ for the current step is formed according to the equation $$X_n=it_n+pT_n \quad \text{G5}$$

by adding the current integral portion $iT_n$ and the current proportional portion $pT_n$.

If the control signal $X_n$ is less than zero (test P4), the control signal $X_n$ is set to zero (equation G6). If on the other hand a control signal $X_n$ which is greater than the control signal value Z is yielded (test P5), which the control signal X would have been set equal to in the event of proper functioning of the sensors S1, S2, S3, S4, then the control signal $X_n$ is set equal to the control signal Z concerned (equation G7). The control signal $X_n$ determined and checked in this way is delivered to the servo motor.

If the method has already been carried out in the presence of a disturbed signal of one of the sensors S1, S2, S3, S4, it is first checked whether the remaining signals are still reliable (test P6). If it turns out here that no further reliable sensor signals can be expected, the method is ended.

If on the other hand there are still reliable sensor signals, it is checked whether the current acceleration $a_{akt}$ which is needed to achieve or to maintain the desired change in the operating state falls below a minimum acceleration $K_{a_min}$ (test P7). If the result of this check is positive, the method is likewise ended.

If on the other hand the current acceleration $a_{akt}$ is above the minimum acceleration $K_{a_min}$, it is checked whether the signals of the signals S3, S4 allocated to the foot pedal 8 indicate that the foot pedal 8 is in an idling position in which the driver is not accelerating (test P8). If the result of this check is positive, the method is likewise ended.

Otherwise the method is continued by determining first according to equations G1, G2 the current gain factors iTG, pTG on the basis of the integral portion $iT_{n-1}$ determined in the previous step, then according to equations G3, G4 the current integral portion $iT_n$ and proportional portion $pT_n$ and lastly according to equation G5 the current control signal $X_n$. After undergoing the tests P4, P5 and any necessary occupation of the current control signal $X_n$ according to equations G6, G7, the current control signal $X_n$ is delivered to the servo motor 7. This procedure is repeated until the engine is turned off or the disturbance of the signals is removed.

What is claimed is:

1. A method for controlling the power supply to a vehicle engine, wherein control signals are delivered to an actuator to control the power supply to the vehicle engine based on signals produced by at least two sensors that monitor a control member to indicate a desired change of vehicle operating state, the method comprising the steps of:

detecting a first event in which a signal produced by one of the sensors is disturbed and a signal produced by the other sensor is undisturbed;

determining the control signals for said actuator based on the undisturbed signal when said first event is detected;

detecting a second event in which the desired change of vehicle operating state indicated by said undisturbed signal exceeds a limit value associated with a current vehicle operating state; and determining the control signals for said actuator based on a proportional-plus integral control when said second event is detected, said proportional-plus integral control including an integral portion having a starting value equal to an initial value allocated to a vehicle operating state in effect when the second event is detected.

2. A method according to claim 1, wherein the control member monitored by the sensors is an actuating means by which a driver of the vehicle chooses the desired change in vehicle operating state.

3. A method according to claim 1, wherein the control member monitored by the sensors is the actuator.

4. A method according to claim 1, wherein said limit value corresponds to said initial value, and the method includes the step of:

allocating said initial value to an engine speed and a gearbox gear speed in effect when said second event is detected.

5. A method according to claim 1, including the steps of:

determining said limit value based on a maximum acceleration associated with a current gearbox gear speed; and detecting said second event when a current acceleration associated with the desired change of vehicle operating state exceeds said maximum acceleration.

6. A method according to claim 1, wherein the step of determining the control signals for said actuator based on said proportional-plus integral control includes the steps of:

determining integral and proportional gain factors based on a previous value of said integral portion;

determining said integral portion based on said integral gain factor, and a proportional portion based on said proportional gain factor; and adding the integral portion and the proportional portion to form the control signals for said actuator.

7. A method according to claim 6, including the step of:

setting the integral gain factor equal to $(iT_{n-1}/TA_{Max})*K_{AGINTG}$, and the proportional gain factor equal to $(iT_{n-1}/TA_{Max})*K_{AGPROPG}$, where $iT_{n-1}$ is the previous value of said integral portion, $TA_{Max}$ is a weighting factor, and $K_{AGINTG}$ and $K_{AGPROPG}$ are constants.

8. A method according to claim 7, including the step of:

setting the weighting factor ($TA_{Max}$) equal to a maximum position of the actuator.

9. A method according to claim 7, including the step of:

setting the integral portion equal to $iT_{n-1}+iTG\ (a_{gew}-a_{akt})$, and the proportional portion equal to $pTG\ (a_{gew}-a_{akt})$, where $iT_{n-1}$ is the previous value of said integral portion, iTG is the integral gain factor, pTG is the proportional gain factor, $a_{gew}$ is a reference value characterizing a desired vehicle operating state, and $a_{akt}$ is a reference value characterizing the current vehicle operating state.

10. A method according to claim 9, wherein the reference value $a_{akt}$ is a current acceleration for achieving or maintaining the desired change of vehicle operating state, and the reference value $a_{gew}$ is a desired acceleration.

11. A method according to claim 1, including the step of:

determining said limit value based on a maximum acceleration associated with a current gearbox gear speed.

12. A method according to claim 1, including the step of:

selecting the starting value of said integral portion in dependence on an engine speed and a gearbox gear speed in effect when said second event is detected.

13. A method according to claim 1, including the step of:

setting said initial value equal to a control signal for maintaining a current acceleration of the vehicle on a road without an inclination, taking into account a gearbox gear speed and a speed of the engine.

14. A device for controlling the power supply to a vehicle engine having at least two sensors (S1, S2, S3, S4) monitoring a control member, evaluating means comparing the current operating state of the vehicle with a desired operating state in dependence on the signals of the sensors (S1, S2, S3, S4), and control means (1) providing controlling signals ($X_n$) to an actuator (5) in dependence on the result of the comparison performed by the evaluating means, which actuator controls the power supplied to the vehicle engine, characterized in that there are provided a memory (**4*a*), in which initial values (R(rpm,g)) are stored in dependence on determined operating states of the vehicle, and a calculating unit (3), which determines the control signals ($X_n$) for the actuator (5) by a proportional-plus integral control unit when in the event of a disturbance of the signal of one of the sensors (S1, S2, S3, S4) the desired operating state is above a limit value (P(g)), wherein the calculating unit (3**) determines the starting value ($iT_0$) of the proportional-plus integral control equal to the initial value (R(rpm,g), P(g)) which is allocated to the respective current operating state.

15. A device according to claim 14, wherein the actuator is the throttle valve (5) in the intake port (6) of an internal combustion engine.

16. A device according to claim 14, wherein the actuating means is a foot accelerator pedal (8) actuated by the driver.

17. A device according to claim 14, wherein one of the sensors (S1, S2, S3, S4) provides a signal which is an inverted signal compared to the respective other sensor (S1, S2, S3, S4).

18. A device according to claim 14, wherein is provided a further memory (**4*b*, 4*c*) in which characteristic values (P) for maximally allowed operating states are stored referring respectively to one gear speed (g) of the vehicle gearbox, which characteristic values the calculating unit (3**) accesses in dependence on a respective gear speed (g) engaged.

* * * * *